United States Patent [19]

Windisch

[11] 4,017,081

[45] Apr. 12, 1977

[54] ELECTRONIC RANDOM SELECTION DEVICE AND AMUSEMENT APPLICATION THEREFOR

[76] Inventor: Anthony J. Windisch, 3882 Walsh St., St. Louis, Mo. 63116

[22] Filed: Dec. 29, 1975

[21] Appl. No.: 645,206

[52] U.S. Cl. ..... 273/138 A; 273/130 B

[51] Int. Cl.[2] ..... A63B 71/06; A63F 5/00

[58] Field of Search ..... 273/1 E, 85 R, 130 AB, 273/130 B, 131 A, 134 A, 135 A, 136 A, 138 A; 315/209; 331/111, 46, 50

[56] References Cited

UNITED STATES PATENTS

| | | | |
|---|---|---|---|
| 3,425,699 | 2/1969 | D'Onofrio | 273/141 |
| 3,715,624 | 2/1973 | Herman | 273/138 A |
| 3,778,063 | 12/1973 | Strand | 273/130 AB |
| 3,791,650 | 2/1974 | Dice | 273/138 A |
| 3,819,186 | 6/1974 | Hinterstocker | 273/138 A |

OTHER PUBLICATIONS

Scott, W. M.; "Electronic Casing"; Radio Electronics; Part I; March, 1974; pp. 45, 50, 51, 52, 86.

Scott, W. M.; "Electronic Casing"; Radio Electronics; Part II; April, 1974; pp. 58, 59.

*Primary Examiner*—Richard C. Pinkham
*Assistant Examiner*—Vance Y. Hum
*Attorney, Agent, or Firm*—James R. Bell

[57] ABSTRACT

An electronic random selection device includes integrated circuits connected to receive a signal from a power source, to generate a first oscillating signal when an associated switch is in a first position and to generate a second oscillating signal, slower than the first oscillating signal, when the switch is in a second position. A plurality of light emitting diodes are sequentially illuminated by the first and second oscillating signals and due to the effect of an interconnected time delay circuit, when the switch is in the second position, the second oscillating signal is ultimately induced to illuminate only one of the diodes. The selection device can be applied to an amusement display such as a playing board having a predetermined array of light penetrable openings formed therein and the light emitting diodes positioned adjacent the openings.

2 Claims, 3 Drawing Figures

ELECTRONIC RANDOM SELECTION DEVICE AND AMUSEMENT APPLICATION THEREFOR

BACKGROUND OF THE INVENTION

1. Field of the Invention

This invention relates generally to amusement devices and games and more specifically to electric or magnetic chance devices.

2. Description of the Prior Art

Generally, electronic random selection devices for use with amusement devices involve rather complicated and thus expensive circuitry. As a result such devices are not usually adaptable for home use since their cost becomes prohibitive. It would be desirable to have a novel, relatively uncomplicated and inexpensive electronic random selection device adaptable for use with games, toys and other amusement devices.

SUMMARY OF THE INVENTION

Accordingly, the present invention provides a novel electronic random selection device adaptable for use with amusement devices which can be mass produced and thus inexpensively provided for home use. The foregoing is accomplished by providing an electronic random selection device including integrated circuits connected to receive a signal from a power source, to generate a first oscillating signal when an associated switch is in a first position and to generate a second oscillating signal slower than the first oscillating signal when the switch is in a second position. A plurality of light emitting diodes are sequentially illuminated by the first and second oscillating signals and due to the effect of an interconnected time delay circuit, when the switch is in the second position, The second oscillating signal is ultimately induced to illuminate only one of the diodes. The selection device can be used in connection with an amusement display such as a playing board having a predetermined array of light penetrable openings formed therein. The light emitting diodes can be positioned adjacent the openings. As a result, the first oscillating signal sequentially illuminates the diodes in the array. The second oscillating signal also sequentially illuminates the diodes but at a slower rate than the first signal. This adds the thrill of anticipation to the amusement. Ultimately, the second sequentially illuminating effect terminates in the illumination of only one of the diodes as the ultimate random selection. This random selection procedure can be repeated singly or conforming to a set of rules or a game plan thus effecting an end result of an amusement nature. The array of openings can be varied as can the placement of the diodes to determine the effect of the illuminating diodes appearing to be either sequentially or randomly illuminated. For example, the array can be circular and the diodes arranged to create a rotating, spinning effect, or the array can be that of a straight line and the diodes arranged to create a linearly moving effect, or the array can be randomly scattered and the diodes arranged to create a random scattered lighting effect.

The foregoing and other advantages and novel features will become apparent from the following detailed description of the invention when considered in conjunction with the accompanying drawings.

BRIEF DESCRIPTION OF THE DRAWINGS

In the drawings wherein like parts are marked alike.

DESCRIPTION OF THE PREFERRED EMBODIMENT

Figure 1:
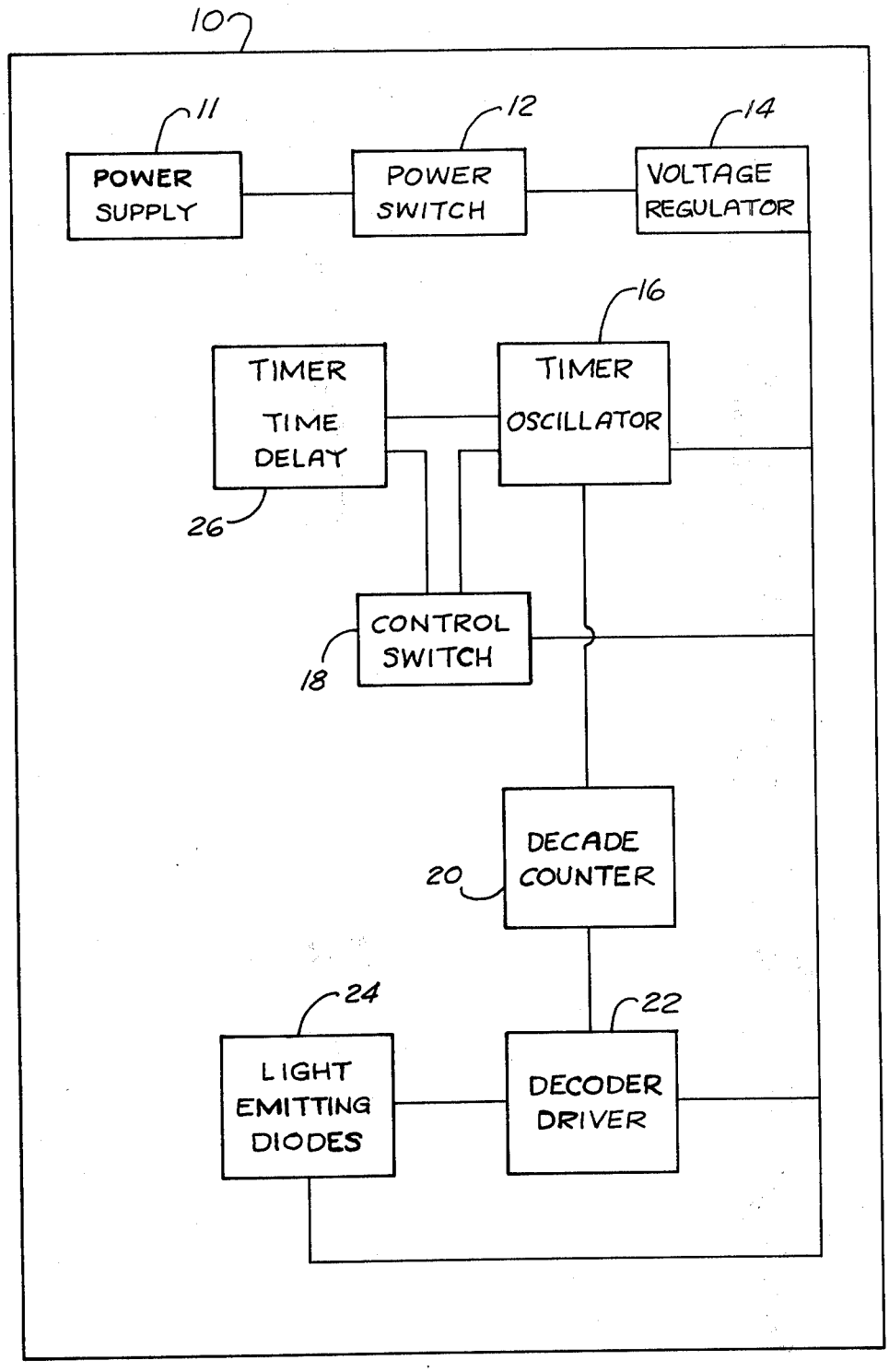
FIG. 1 is a block illustration of the electronic random selection device of the present invention.

Referring now to the drawings, it can be seen in FIG. 1 that random selection device 10 includes power supply 11 connected to a power switch 12 which is connected to voltage regulator 14. The voltage regulator is connected to first timer circuit 16, control switch 18, decade counter 20, decoder driver 22 and a plurality of light emitting diodes 24*a–j*. Second timer circuit 26 is connected to first timer circuit 16 and control switch 18.

Figure 2:
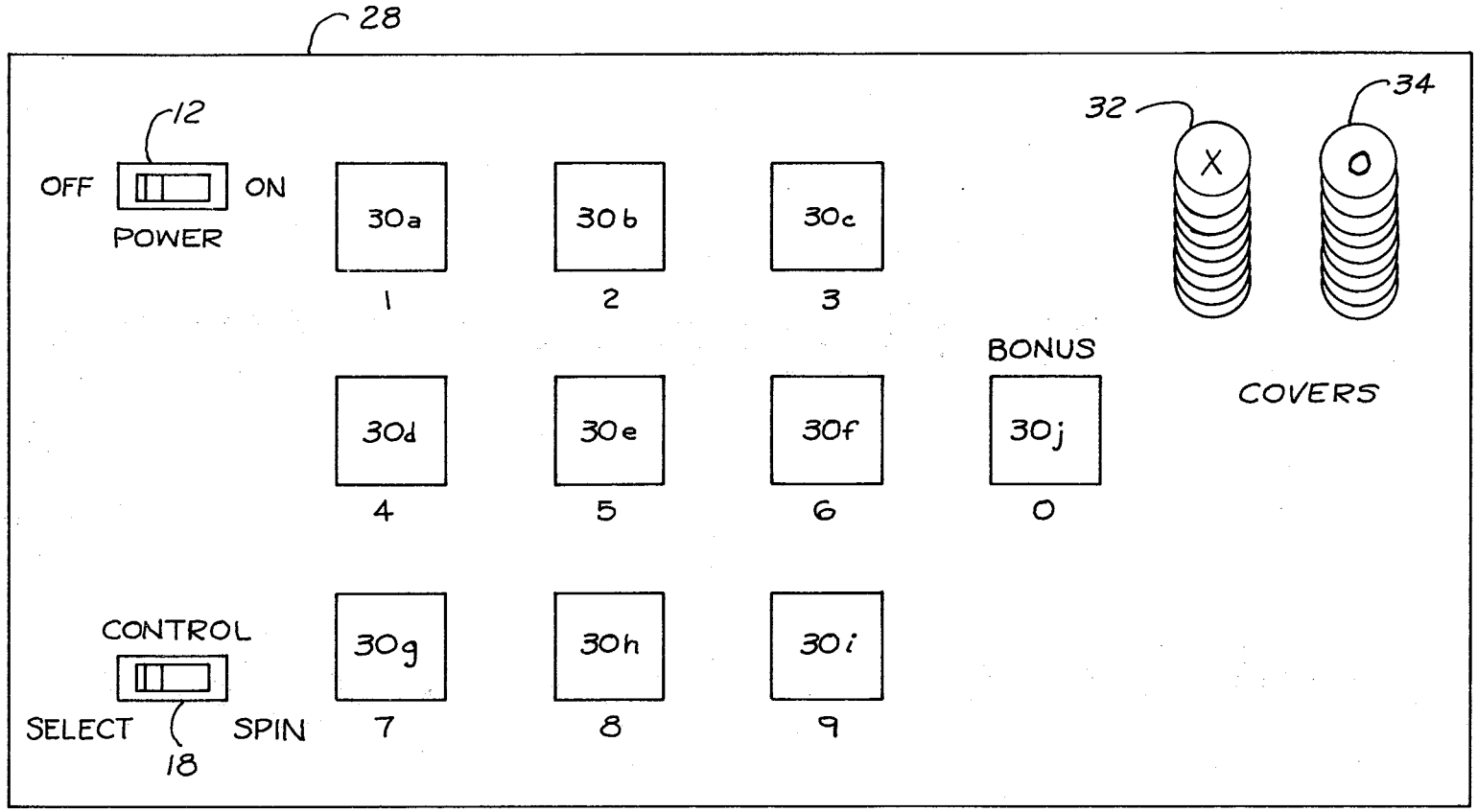
FIG. 2 is an illustration of one type of playing board for use with the selection device of this invention.

With the interconnected components of the random selection device 10 assembled, they can be used in combination with a playing board 28, FIG. 2, having a plurality of light penetrable openings 30*a–j*, also designated 0–9, formed in board 28 in a predetermined array such as, for example, a conventional tic-tac-toe configuration including nine light penetrable openings 30*a–i* and a tenth or bonus opening 30*j*. Light emitting diodes 24*a–j* can be situated adjacent corresponding openings 30*a–j*. Power switch 12 can be mounted in board 28 including indicated off-on positions. Control switch 18 can also be mounted in board 28 including indicated select-spin positions. A plurality of covers including some designated "X" thereon and others designated "O" thereon and indicated 32, 34 respectively, are provided to be placed over the openings.

Figure 3:
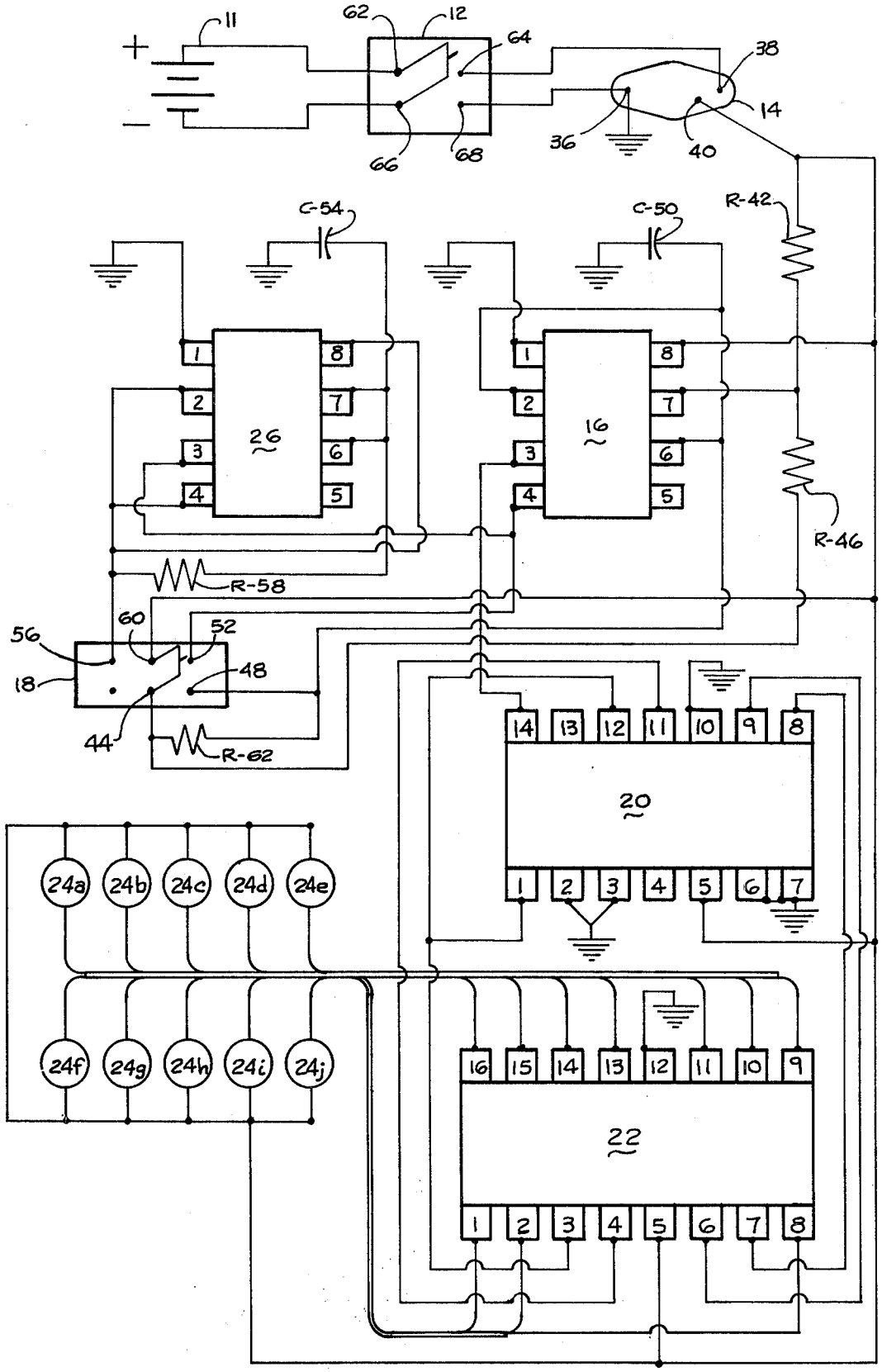
FIG. 3 is a wiring diagram of the random selection device of this invention.

The wiring diagram of FIG. 3 illustrates power supply 11 which is preferably a six volt power source which may comprise four 1.5 volt direct current batteries such as commonly available type "D" cells. Power supply 11 is connected by appropriate conductors to power switch 12 preferably a commercially available double pole single throw type switch including circuit open (off) position wherein pins 62, 64 and pins 66, 68 thereof are not electrically connected, and a circuit closed (on) position wherein those pins are connected. Switch 12 is illustrated in the circuit open (off) position.

Switch 12 is connected by appropriate conductors to voltage regulator 14 at pin 36 which is connected to ground and at pin 38. Voltage regulator 14 is a commercially available item such as, for example, the product LM-309K voltage regulator, catalogue number 276–1830 sold under the Trademark ARCHER. Such a voltage regulator is a 5 volt regulator fabricated on a single silicon chip. These regulators are provided to employ internal current limiting, thermal shutdown, and safe-area compensation which makes the circuitry essentially blow-out proof. As used in the device of this invention, output at pin 40 of regulator 14 is substantially 5.25 volts.

Of course an appropriate resistor can be used in place of voltage regulator 14 for the purpose of dropping voltage from source 11 to the desired control voltage. However, it should be recognized that use of voltage regulator 14 rather than a resistor is advantageous in that the voltage regulator offers protection against circuit overload whereas a resistor would not offer such protection.

Voltage output pin 40 of regulator 14 is connected by an appropriate conductor to pin 8 of commercially available linear integrated timer circuit 16 such as, for example, the product type 555 Integrated Circuit Timer catalogue number 276–1723 sold under the Trademark ARCHER. Such a timer circuit is a highly stable controller capable of producing oscillation or accurate time delays. For a stable operation as an oscillator, the free running frequency and the duty cycle are both accurately controlled with two external resistors and one capacitor. Pin 7 of circuit 16 connects to pin 40 of regulator 14 through an appropriate conductor interconnected by resistor R42, a 4.7 k-ohm resistor. Also pin 7 of circuit 16 connects to pin 44 of control switch 18 through an appropriate conductor interconnected by resistor R46, a 68 k-ohm resistor. Pin 6 of circuit connects to pin 48 of control switch 18 and also to pin 2 of circuit 16; both pins 2 and 6 being connected to ground via capacitor C50, a 1 micro-farad capacitor. Pin 4 of circuit 16 connects to pin 3 of second timer circuit 26, to be discussed later in greater detail, and also connects to pin 52 of control switch 18. Pin 1 of circuit 16 goes to ground.

Pin 3 of circuit 16 connects to pin 14 of commercially available integrated circuit decade counter 20 such as, for example, the product type 7490, catalogue number 276–1808, TTL Integrated Circuit Decade Counter sold under the Trademark ARCHER. Such a decade counter comprises a high-speed, monolithic decade counter having four dual-rank, master-slave flip-flops internally interconnected to provide a divide-by-two and a divide-by-five counter. Gated direct reset lines are provided to inhibit count inputs and return all outputs to a logical "O" or to a binary coded decimal (BCD) count of 9. When used as a BCD decade counter, the binary decimal input, pin 1, must be externally connected to output pin 12. Pin 14 receives the incoming count and a count sequence is obtained in accordance with the table shown below:

| COUNT | OUTPUT | | | |
|---|---|---|---|---|
| | Pin 11 | Pin 8 | Pin 9 | Pin 12 |
| 0 | 0 | 0 | 0 | 0 |
| 1 | 0 | 0 | 0 | 1 |
| 2 | 0 | 0 | 1 | 0 |
| 3 | 0 | 0 | 1 | 1 |
| 4 | 0 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |

In addition to a conventional "O" reset, inputs are provided to reset a BCD 9 count for nine's compliment decimal applications. Input voltage from pin 3 of timer circuit 16 enters counter 20 at pin 14 thereof. Control voltage from pin 40 of regulator 14 is provided at pin 5 of counter 20. Pins 2, 3, 6, 7 and 10 of counter 20 go to ground. Pins 12 and 1 are interconnected. Pin 11 of counter circuit 20 is connected to pin 4 of decoder driver 22, to be discussed later in greater detail. Pin 12 of counter circuit is connected to pin 3 of driver 22. Pins 9 and 8 of counter circuit 20 are connected to pins 6 and 7, respectively, of driver 22.

Integrated circuit BCD-to-decimal decoder/driver 22 is connected to receive control voltage at pin 5 thereof from pin 40 of regulator 14. Decoder/driver circuit 22 is commercially available such as, for example, the product type 7441, catalogue number 276–1804, TTL Integrated Circuit BCD-to-Decimal Decoder/Driver sold under the Trademark ARCHER. Such decoder/-driver integrated circuits incorporate high performance output transistors designed for driving gas filled, cold cathode indicator tubes. The decoder comprises TTL gate circuits which select one of ten output drivers. Inputs from pins 8, 9, 11 and 12 of counter circuit 20 are connected to be provided at pins 7, 6, 4 and 3, respectively, of decoder 22. Pin 12 of decoder 12 is connected to ground. Output from pins 1, 2, 8, 9, 10, 11, 13, 14, 15 and 16 are connected to provide input voltage for light emitting diodes 24*a–j*.

Light emitting diodes 24*a–j* are connected to receive control voltage from pin 40 of regulator 40 and to receive input from decoder 22 as stated above. Diodes 24*a–j* are commercially available such as, for example, the product Light Emitting Diode, catalogue number 276–041, sold under the Trademark ARCHER.

Timer circuit 26 is connected to timer circuit 16 and to control switch 18. Timer circuit 26 is the same product as circuit 16, hereinabove described but is connected to provide a time delay to the random selection device. Pin 1 of circuit 26 goes to ground as does pin 7 via capacitor C-54, a 5 micro-farad capacitor. Pins 2, 4 and 8 are interconnected. Pin 3 of timer 26 is connected to pin 4 of timer 16. Pins 6 and 7 of timer 26 are interconnected and are connected to pin 56 of switch 18 via resistor R-58, a 940 k-ohm resistor, whereas interconnected pins 2, 4 and 8 are directly connected to pin 56 of switch 18. Pin 60 of switch 18 is connected to receive control voltage from pin 40 of regulator 14. Interconnected pins 2 and 6 of timer 16, connected to pin 48 of switch 18 and pin 7 of timer 16 connected to pin 44 of switch 18 can be interconnected by resistor R-62, a 270 k-ohm resistor when switch 18 is positioned to open between pins 44 and 48 thereof. Control switch 18 is preferably a commercially available double pole, double throw switch including a "spin" or first position wherein pins 60, 52 and 44, 48 are interconnected with pins 60, 56 open, and a "select" or second position wherein the pins 60, 52 and pins 44, 48 are open and pins 60, 56 are interconnected.

In operation, with the wiring diagram completed as hereinabove described, power switch 12 is closed or connected in the "on" position interconnecting pins 62, 64 and pins 66, 68 thereof. Control switch 18 is in the "spin" position interconnecting pins 60, 52, and 44, 48 thereof. Control voltage is provided directly from pin 40 of regulator 14 to pin 8 of first timer circuit 16. Also, power is indirectly provided to pin 7 of timer 16 via resistor R-42 and to pin 6 of timer 16 via resistor R-42 and additional resistor R-46 and through pins 44, 48 of switch 18. Through the internal circuitry of timer 16, current builds for discharge from pin 6 to ground through capacitor C-50 thus triggering shut down of the internal circuitry of timer 16 via pin 2 thereof. Due to the interconnection of pins 60, 52 of switch 18 in the "spin" position, control voltage from pin 40 of regulator 14 is provided to pin 4 of timer 16 to reset the circuit after shut-off. The cycle is repeated resulting in a continuous first oscillating signal produced by timer circuit 16. The on-off output of timer 16 is conducted from pin 3 of timer 16 to pin 14 of decade counter 20 resulting in a continuous binary counting of the number of pulses numbering 0–9. These pulses are provided (in binary code) from pins 8, 9, 11 and 12 of counter 20 as input to pins 3, 4, 6 and 7 of decoder/driver 22 which, upon receiving the input, decodes or interprets the binary coded decimal into ten separate outputs which are fed to diodes 24*a–j* from pins 1, 2, 8, 9, 10, 11, 13, 14, 15 and 16 of decoder 22.

When switch 18 is placed in the "select" position pins 60, 52 and 44, 48 thereof are open and pins 60, 56 are closed. As a result, resistor R-62 is introduced into the circuit to influence timer 16 thus stepping down the first oscillating signal fed into pin 6 of timer 16 and results in a second oscillating signal slower than the first oscillating signal. Placing switch 18 in the "select" position also connects control voltage from pin 40 of regulator 14 through interconnected pins 60, 56 of switch 18 to introduce second timer circuit 26 and disconnects that voltage to pin 4 of timer 16 by opening pins 60, 52 of switch 18. Control voltage is connected directly to timer 26 at pins 2, 4 and 8 and indirectly at pins 6 and 7 via resistor R-58, and a new source of reset voltage is supplied from pin 3 of timer 26 to pin 4 of timer 16. Through the internal circuitry of timer 26, current builds for discharge from pin 7 to ground through capacitor C-50 thus, after a time delay, triggers shut-down of the internal circuitry of timer 26. Thus the new reset voltage source from pin 3 of timer 26, supplied to timer 16, is turned off and the slower, second oscillating signal is stopped to illuminate only one of the diodes 24*a–j.*

With the diodes 24*a–j* placed adjacent the light penetrable openings 30*a–j* of playing board 28, FIG. 2, a sequential lighting effect can be applied to the openings 0–9 on the board. Two players can use the board for an electronic tic-tac-toe amusement device. Play can be conducted as follows:

1. Power switch 12 can be placed in the "on" position;
2. control switch 18 can be placed in the spin position to effect a random lighting effect of openings 30*a–j* at the first oscillating signal;
3. one player can select odd or even numbers of openings 30*a–i;*
4. another player can switch control to "select";
5. the diodes now light sequentially from openings 0–9 at the slower, second oscillating signal;
6. ultimately the sequential lighting stops illuminating only one of the openings and the odd or even number of the lighted opening determines which player beings play;
7. the other player has a choice of either the "X" or "O" covers;
8. play begins with one player switching control from "spin" to "select";
9. when the rotating lights stop, the player places his cover over the one illuminated opening, or if the bonus (O) opening is illuminated that player may place his cover on any other opening not covered, or that player may remove any one of his opponent's covers;
10. the above sequence is repeated alternately by both players;
11. if a selected opening is already covered it can not be covered by a new or additional cover but if covered by an opponent's cover, it may be removed; and
12. when three openings are covered in a row (horizontal, vertical or diagonal), the game is over.

The foregoing has described a novel, relatively uncomplicated and inexpensive electronic random selection device adaptable for use with games, toys and similar amusement devices. Many modifications and variations of the present invention are possible in the light of the above teachings. It is therefore to be understood that within the scope of the appended claims the invention may be practiced otherwise than as specifically described.

What is claimed is:

1. An electronic random selection device comprising in combination:

a control switch having first and second selectable positions;

first integrated timer circuit means connected for generating a signal oscillating at a first constant rate when the control switch is in the first position;

resistance means connected for causing the first timer circuit means to generate a signal oscillating at a second constant rate, slower than the first rate, when the control switch is in the second position;

second integrated timer circuit means connected for generating a time delay signal to the first timer circuit means when the control switch is in the second position;

integrated decade counter circuit means connected to the first timer circuit means for receiving a signal therefrom and for generating a binary coded decimal count;

integrated decoder/driver circuit means connected to the decade counter circuit means for receiving a signal therefrom and for decoding the signal to a decimal equivalent signal thereof; and a plurality of light emitting diode means connected to the decoder/driver circuit means for receiving the signal oscillating at the first rate for sequentially illuminating the diodes at a rate corresponding to the first rate when the switch is in the first position, for receiving the signal oscillating at the second rate for sequentially illuminating the diodes at a rate corresponding to the second rate when the switch is in the second position and for receiving the time delay signal for ultimately illuminating only one of the diodes when the switch is in the second position.

2. An electronic amusement device comprising in combination:

a playing board having a plurality of light penetrable openings formed therein, the openings formed in a predetermined array;

a control switch having first and second selectable positions;

first integrated timer circuit means connected for generating a signal oscillating at a first constant rate when the control switch is in the first position;

resistance means connected for causing the first timer circuit means to generate a signal oscillating at a second constant rate, slower than the first rate, when the control switch is in the second position;

second integrated timer circuit means connected for generating a time delay signal to the first timer circuit means when the control switch is in the second position;

integrated decade counter circuit means connected to the first timer circuit means for receiving a signal therefrom and for generating a binary coded decimal count;

integrated decoder/driver circuit means connected to the decade counter circuit means for receiving a signal therefrom and for decoding the signal to a decimal equivalent signal thereof; and a plurality of light emitting diode means adjacent the openings connected to the decoder/driver circuit means for receiving the signal oscillating at the first rate for sequentially illuminating the diodes at a rate corresponding to the first rate when the switch is in the first position, for receiving the signal oscillating at the second rate for sequentially illuminating the diodes at a rate corresponding to the second rate when the switch is in the second position and for receiving the time delay signal for ultimately illuminating only one of the diodes when the switch is in the second position.

* * * * *